US009866940B2

(12) United States Patent
Walker et al.

(10) Patent No.: US 9,866,940 B2
(45) Date of Patent: Jan. 9, 2018

(54) WATERPROOF HEADPHONES

(71) Applicant: Underwater Audio LLC, Corvallis, OR (US)

(72) Inventors: Todd Walker, Corvallis, OR (US); Scott Walker, Corvallis, OR (US); Justin Zsiros, Provo, UT (US); Mark G. Nader, Colorado Springs, CO (US)

( * ) Notice: Subject to any disclaimer, the term of this patent is extended or adjusted under 35 U.S.C. 154(b) by 0 days.

(21) Appl. No.: 14/925,232

(22) Filed: Oct. 28, 2015

(65) Prior Publication Data

US 2017/0026734 A1 Jan. 26, 2017

Related U.S. Application Data

(60) Provisional application No. 62/069,576, filed on Oct. 28, 2014.

(51) Int. Cl.
*H04R 25/00* (2006.01)
*H04R 1/10* (2006.01)

(52) U.S. Cl.
CPC ..... *H04R 1/1016* (2013.01); *H04R 1/1075* (2013.01); *H04R 1/1091* (2013.01)

(58) Field of Classification Search
CPC .. H01R 13/5202; H01R 13/5219; H04R 1/02; H04R 1/10; H04R 1/1016; H04R 1/101075; H04R 1/1091; H04R 5/0335; H04R 25/652
See application file for complete search history.

(56) References Cited

U.S. PATENT DOCUMENTS 9,420,366 B2 * 8/2016 Whitney ..... H04R 1/1033
2012/0195455 A1 * 8/2012 Chiba ..... H04R 1/1091 381/374
2015/0139474 A1 * 5/2015 Henry ..... H04R 1/1016 381/380

* cited by examiner

*Primary Examiner* — Brian Ensey
(74) *Attorney, Agent, or Firm* — Edward E. Sowers; Brannon Sowers & Cracraft PC

(57) ABSTRACT

A variety of different implementations of waterproof headphone designs are disclosed as well as techniques for producing the same. The disclosed headphones may include one or more features which increase the buoyancy of the headphones.

14 Claims, 16 Drawing Sheets

WATERPROOF HEADPHONES

CROSS REFERENCE TO RELATED APPLICATIONS

This application is related and claims priority to U.S. Provisional Patent Application No. 62/069,576 filed on Oct. 28, 2014, which is incorporated by reference herein.

FIELD

The claimed technology relates generally to headphones, and more particularly, to water resistant and waterproof headphones for delivering audio to a user in wet weather and aquatic environments.

BACKGROUND

Water sports remain popular as recreational activities. Similarly, there are activities performed under extreme weather conditions and/or aquatic environments that require the participant to receive audio information. However, waterproof and/or water resistant headphones often suffer from poor sound reproduction as a consequence of the waterproofing. Further, variances in production can lead to production batches of headphones that are not reliably waterproof. Finally, the ear tips of many current waterproof headphones, necessarily fitting snugly within the ear canal, will often dislodge and remain within the ear canal when the headphones are removed. Thus, there is a need for the described invention.

SUMMARY

The claimed technology is set forth in the claims below, and the following is not in any way to limit, define or otherwise establish the scope of legal protection. In general terms, the claimed technology relates to various implementations of waterproof headphones.

A waterproof headphone, according to one implementation of the present invention relates to a headphone having a housing, separable from the ear tip, such that the area of union of the ear tip and housing is configured to be attachable and resistibly detachable. Additionally, said implementation is further configured to accept and be functional with a wide variety of ear tips such that generic and/or custom ear tips, even from other manufactures, are suitable.

A waterproof headphone, according to one implementation of the present invention relates to a headphone having a housing composed of two components, a rear housing and a front housing. The two components are fixedly joined by a modified double lap joint. The rear housing is edged with the receiving portion of a modified double lap joint. The front housing is edged with the penetrating portion of the modified double lap joint.

A waterproof headphone, according to one implementation of the present invention relates to a headphone having a water-tight housing such that the housing maintains positive buoyancy enabling the headphones as a whole to float.

A waterproof headphone, according to another aspect of the present invention relates to a headphone having a sound expansion chamber followed by a sound funnel. The sound expansion channel, preceding the sound funnel, matched to the size of the speaker element enhances the transmission of lower frequencies through the sound funnel and into the ear of the listener.

A waterproof headphone, according to still another aspect of the present invention relates to a headphone having a stepped, cylindrical speaker receptacle area. The stepped, cylindrical speaker receptacle having a larger diameter portion preceded by a smaller diameter portion. The larger diameter portion is sized to receive a speaker. The smaller diameter portion is sized such that the ledge of the smaller diameter portion supports a speaker support (typically a foam support), in turn supporting the speaker.

A waterproof headphone, according to still another aspect of the present invention relates to a headphone having a wire sheath incorporated into the rear housing such that a water tight seal can be made against the headphone wire by sealing the gap between the wire and the sheath. In some implementations, the wire sheath is molded as part of the rear housing.

These and other embodiments can each optionally include one or more of the following features. The front housing portion of the waterproof headphone can also include a cylindrical portion upon which the ear tip resides. The cylindrical portion is ringed by backwards facing incline planes. The rings of backwards facing incline planes serving to retard detachment of the ear tip from the headphone. The rear housing portion of the waterproof headphone can also include a speaker retention tab that serves to provide distributed, securing pressure against the speaker.

The details of one or more embodiments of the subject matter described in this specification are set forth in the accompanying drawings and the description below. Further objects, embodiments, forms, benefits, aspects, features and advantages of the claimed technology may be obtained from the description, drawings, and claims provided herein.

DESCRIPTION

Figure 1:
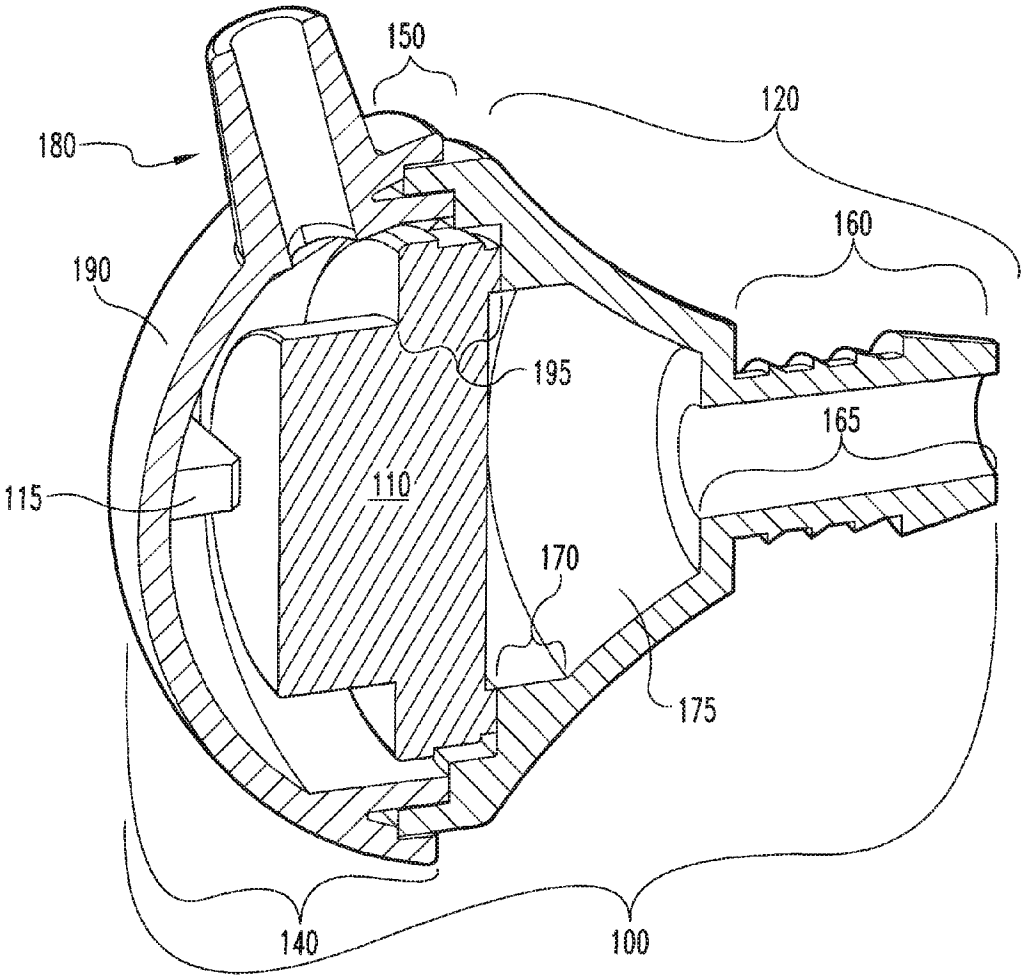
FIG. 1 is a cut-away side representation of one implementation of a waterproof headphone according to the disclosed technology.

For the purposes of promoting an understanding of the principles of the claimed technology and presenting its currently understood best mode of operation, reference will now be made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would normally occur to one skilled in the art to which the claimed technology relates.

FIG. 1 is a cut-away side representation of one implementation of a waterproof headphone 100. Included in the depiction of FIG. 1 of the waterproof headphone 100 is the front housing 120, the rear housing 140, an earbud (cushion) attachment location or earbud tube 160, a sound expansion chamber 170, a sound funnel 175, a wire sheath 180, a speaker 110, a speaker support 115, a speaker receiving segment 190, and a housing connection joint 150. In some implementations, the front housing 120 and the rear housing 140 are constructed from acrylonitrile butadiene styrene (ABS). However, those skilled in the art will understand that the front housing 120 and the rear housing 140 can be constructed from any suitable material of a similar nature. For example, the housings 140 and 120 can be constructed from high-impact polystyrene (HIPS), polypropylene, polycarbonate, and the like.

In some implementations, the front housing 120 and the rear housing 140 are mechanically joined at a housing connection joint 150. The housing connection joint 150 is further described in FIG. 3.

The speaker 110 resides within the speaker receiving segment 190. The speaker receiving segment 190 can be described as a cylinder, sized to allow the speaker 110 to reside within. The speaker 110 is then retained within the speaker receiving segment 190 by 25 the speaker support 115. The speaker support 115 applies an area of uniform pressure against the speaker 110. In some implementations, the speaker support 115 can take a different shapes such as a raised ring, a series of raised concentric rings, a collection of raised contact points, and the like, rather than the portrayed raised bar. Pressure against the speaker 110 from the speaker support 115 is directed against a speaker ring (not shown) that resides between the speaker and the lip 195. In some implementations, the speaker ring is made out of a foam rubber however any suitable material such as felt, cotton, and the like can be used.

The combination of the receiver segment 190 in conjunction with the speaker support 115 allows secure speaker placement regardless of small variations caused by mass production in the housings 140 and 120. Furthermore, the lip 195 maximizes the area for the placement of a speaker cushioning foam ring (not shown).

In this implementation, the wire sheath 180 is molded as part of the rear housing 140. However, those skilled in the art will appreciate that the wire sheath 180 could be formed separately and secured to the rear housing 140. The wire sheath 180 allows the headphone wire (not shown) to enter the headphone 100 while maintaining the water-tight aspect of the waterproof headphone 100. In some implementations, the wire is further protected and enhanced through the use of a bladder-like-construct or buoyantly positive foam covering a segment of the wire such that the headphone assembly as a whole will float upon the surface of a body of water. In some implementations, after the wire is inserted, the wire sheath 180 is filled with a sealant to secure against penetration by water. For example, an epoxy, a polymer expansive sealant, a gap spanning and resilient caulk, and the like can be used to fill 15 the gap between the wire and the wire sheath 180.

In some implementations the speaker is followed by a sound expansion chamber 170. The sound expansion chamber 170 is followed by the sound funnel 175. In some implementations, the diameter of the sound expansion chamber is equal to or approximately equal to that of the face of the speaker 110. Those skilled in the art will appreciate that the sound expansion chamber 170 allows formation or partial formation of sound waves, serving to limit distortion and undesirable amplification of certain frequencies by the sound funnel 175. In some way, the sound expansion chamber 170 and sound funnel 175 can be thought of or modeled as an expansion chamber with a variable ratio of the inlet cross-sectional area to the cross-sectional area of the expansion chamber. In such a representation, the sound outlet would be the ear bud tube 160.

Additionally, in some implementations the earbud tube 160 is ringed with rearward facing incline planes (teeth) to allow ear cushions to be more securely attached. The earbud tube 160 is further described in FIG. 4. Those skilled in the art will recognize that the earbud tube 160 terminates into a steep shoulder of the forward assembly 120. The steep shoulder stops the insertion of the earbud tube 160 into the earbud. Similarly, the steep shoulder also serves as a stop against overly deep placement of the headphone into the ear canal.

Further, those skilled in the art will recognize that the shape, as a whole, works to alleviate a risk found with many sports headphone devices. Participants in sports and physical activities understand that their headphones may become loose as a consequence of their activity. In an attempt to prevent the headphones from becoming loose, some participants will insert their headphone as far as possible into their ear canal. This can damage the ear. The bulb-like shape of the water proof headphone 100 allows only the earbud tube 160 to enter into the ear canal, preventing the user from harming himself.

Figure 2:
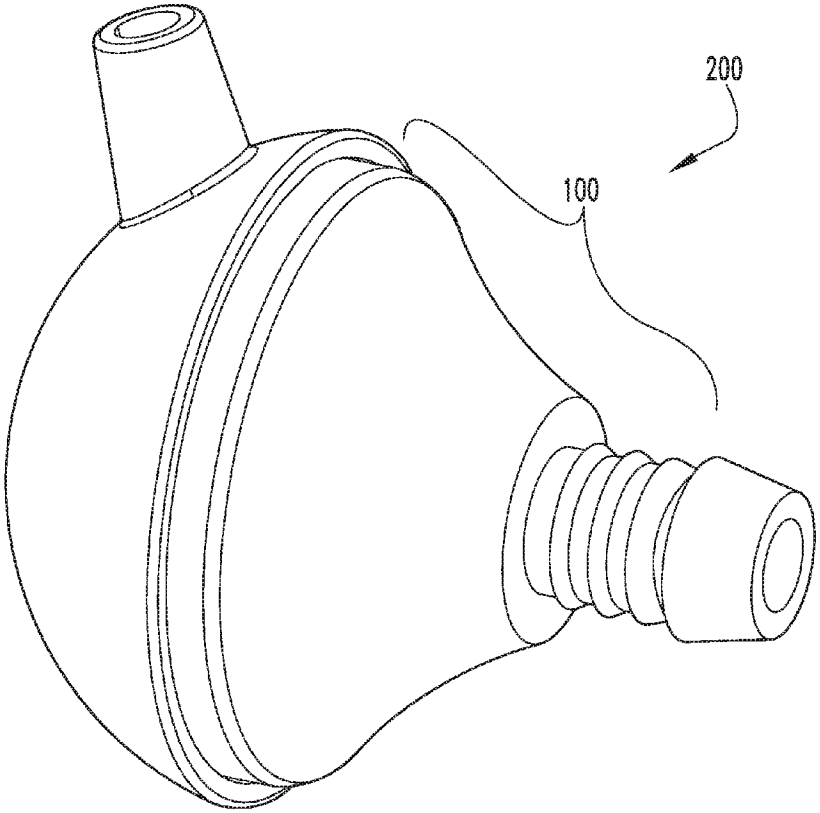
FIG. 2 is an x-ray representation of one implementation of a waterproof headphone according to the disclosed technology.
Figure 3:
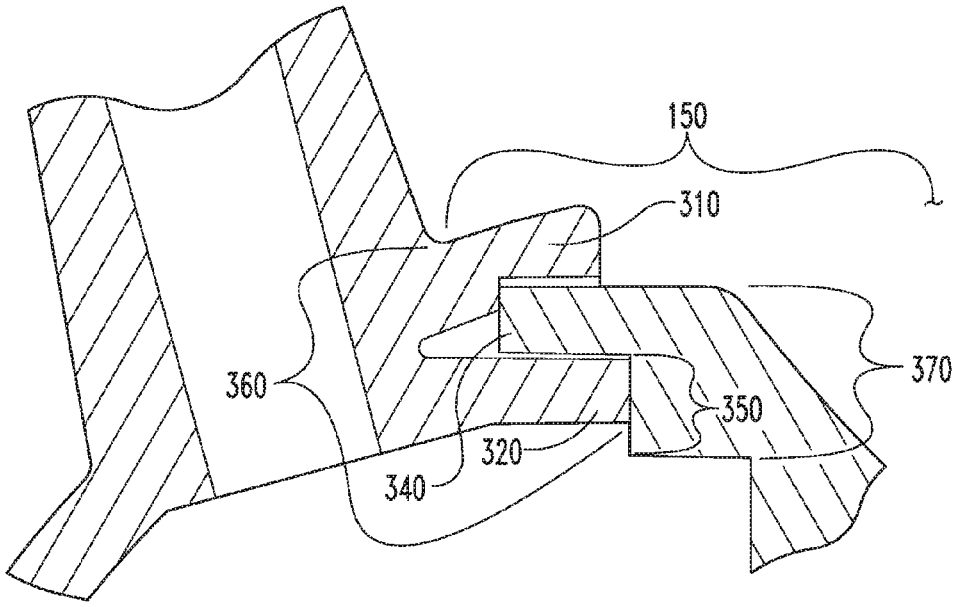
FIG. 3 is an expanded, side view of a housing connection joint according to the disclosed technology.

FIG. 2 is an x-ray representation of one implementation of the waterproof headphone 100. FIG. 3 is an expanded, side view of the housing connection joint 150 of the FIG. 1 depicted implementation 100. The housing connection joint 150 has some similarities to a modified double lap joint. It should be understood that the depicted connection joint 150 is non-limiting and that that other joint configurations are possible subject to the requirement of enabling a water-tight seam or somehow otherwise providing for a water-proof headphone. The receiving portion 360 of the housing connection joint 150 has a top protrusion 310, a lower protrusion 320, and a receiving gap 330. The penetration portion 370 has a penetration protrusion 340 and a rabbit 350 mated to the receiving portion's lower protrusion 320. The receiving gap 330 is deeper than the length of the penetrating protrusion 340. The penetrating protrusion 340 is of length and shaped such that the penetrating protrusion 340 and the rabbit 350 will make a securable connection to the receiving portion 360. It should be understood that the housing connection joint 150 allows a secure and water tight housing to be formed even in the face of manufacturing variances. For example, the receiving gap 330 allows production varying amounts of glue or adhesive to be used and the rabbit 350 along with the penetrating protrusion 340 ensure that sufficient area is secured against the receiving portion 360. It should also be understood that while described as being glued together, the two housings 140 and 120 can be secured through other means of bonding the housing connection joint 150 together. For example, RF welding, ultrasonic welding, and the like could be used instead of an adhesive or glue to secure the housing connection joint 150.

Figure 4:
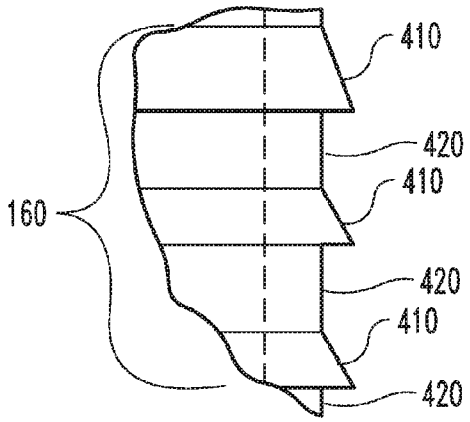
FIG. 4 is a detail side representation of a ring incline planes of the ear tip attachment location according to the disclosed technology.

FIG. 4 is a detail side representation of the ring incline planes or teeth 410 of the earbud attachment location 160. The teeth 410, by having an incline slope towards the rear housing 140 work to more fixedly attach an earbud (not shown) to the earbud tube 160. More specifically, because the earbud is composed of a flexible and compressible material, the teeth 410 work to allow the ear bud to slide onto the earbud tube 160. Once attached, an earbud will expand such that some portion of the earbud is behind the teeth 410, partially filling the tooth gaps 420. When detachment pressure is asserted against the earbud, the portion of the ear bud filling the tooth gaps retard detachment of the ear bud. That is, the grooved, serrated, or barbed design of the ear bud attachment location 160 creates multiple seals between the surface of the ear bud attachment location 160 and an earbud. The teeth 410 or groove along the earbud attachment location 160 creates a seal when inserted into an ear bud. The multiple seals between the inside of the earbud shaft and the ear bud attachment location 160 created by these teeth 410 or grooves prevent any water from penetrating into the interface between the headphone and earbud assembly. Alternatively, it can be described as the teeth 410 bite into the ear bud when detachment pressure is applied and the teeth 410 create a superior, waterproof seal.

Additionally, the teeth 410 or groove along the earbud attachment location 160 allows the waterproof headphone 100 to be used with a variety of ear buds. The ability of interfacing with many different shapes, sizes, and designs of earbud and earplug provides the user with more options to choose from to find an earbud or earplug that maximizes the comfort and utility of the headphone for the user. For example, ergonomically shaped earbuds that match the shape of the user's outer-ear and ear canal, standard earbuds, regular ear plugs, and the like can be natively used with the waterproof headphone 100. In the case of ergonomically shaped ear buds, those skilled in the art will recognize that the sloped shape of the front housing 140, near the earbud attachment location 160 provides sufficient room for the attachment of said ergonomically shaped earbud to the waterproof headphone 100. Further, the teeth 410 or groove along the ear bud attachment location 160 allows the earbud or earplug to be securely detachably attached without the use of adhesive or additional attachment elements.

Figure 5C:
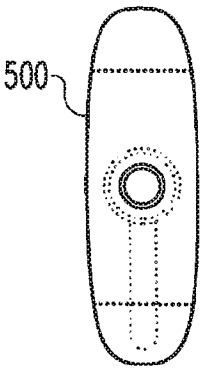
FIG. 5C is an end view of the disclosed technology shown in FIG. 5A.
Figure 5A:
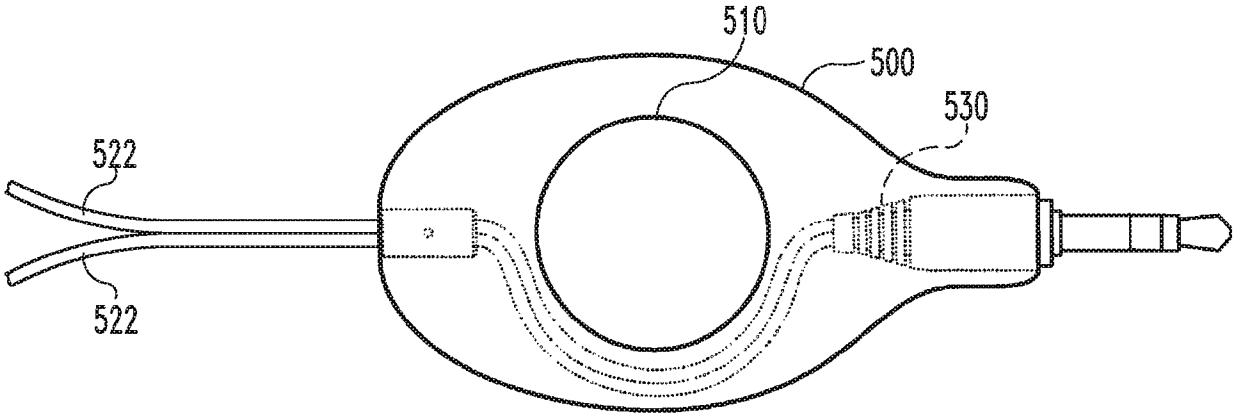
FIG. 5A is a representation of one implementation of a durability flotation enhancement according to the disclosed technology.
Figure 5B:
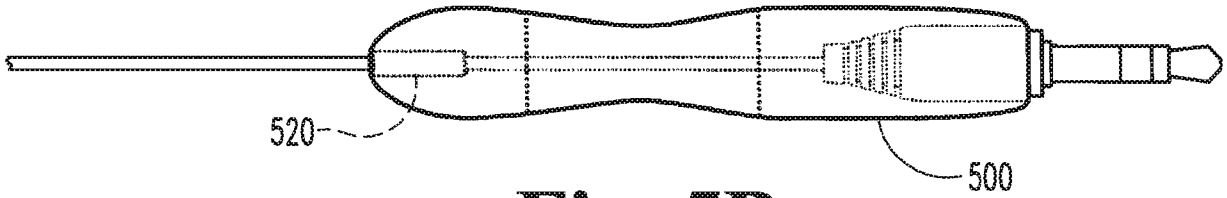
FIG. 5B is a side view of the disclosed technology shown in FIG. 5A.

FIGS. 5A-C are a representation of one implementation of an ergonomically adapted plug 500. In this implementation, the ergonomically adapted plug 500 is comprised of a buoyant foamed rubber or polymer of sufficient size as to ensure that the headphone assembly as a whole will not sink to the bottom of a body of water. However, other implementations may vary in their buoyancy. This implementation 500 has a grip hole 510 in the center, providing a superior grasping area, and covers the cord reinforcement block at the rear portion 530 of the plug as well as a reinforcing block 520 proximal to where the cords 522 enter the plug 500 (shown in outline). The ergonomically adapted plug 500 is also oval in shape to further enhance the plug's 500 ability to be grasped. In this implementation of the ergonomically adapted plug 500, the buoyant foamed rubber or polymer is has a non-slip surface finish. For example, there can be a friction enhancing matt enabling superior grasping when wet. The ergonomically adapted plug 500 also receives the stress and strain from tensions placed on the wire, in effect providing additional protection for the wire to plug connection point.

Those skilled in the art will understand that other shapes are possible for the ergonomically adapted plug 500. For example, some implementations of the ergonomically adapted plug 500 may not have a grip hole 510, may have an overall shape similar to that of a cylinder, and the like.

Figure 6:
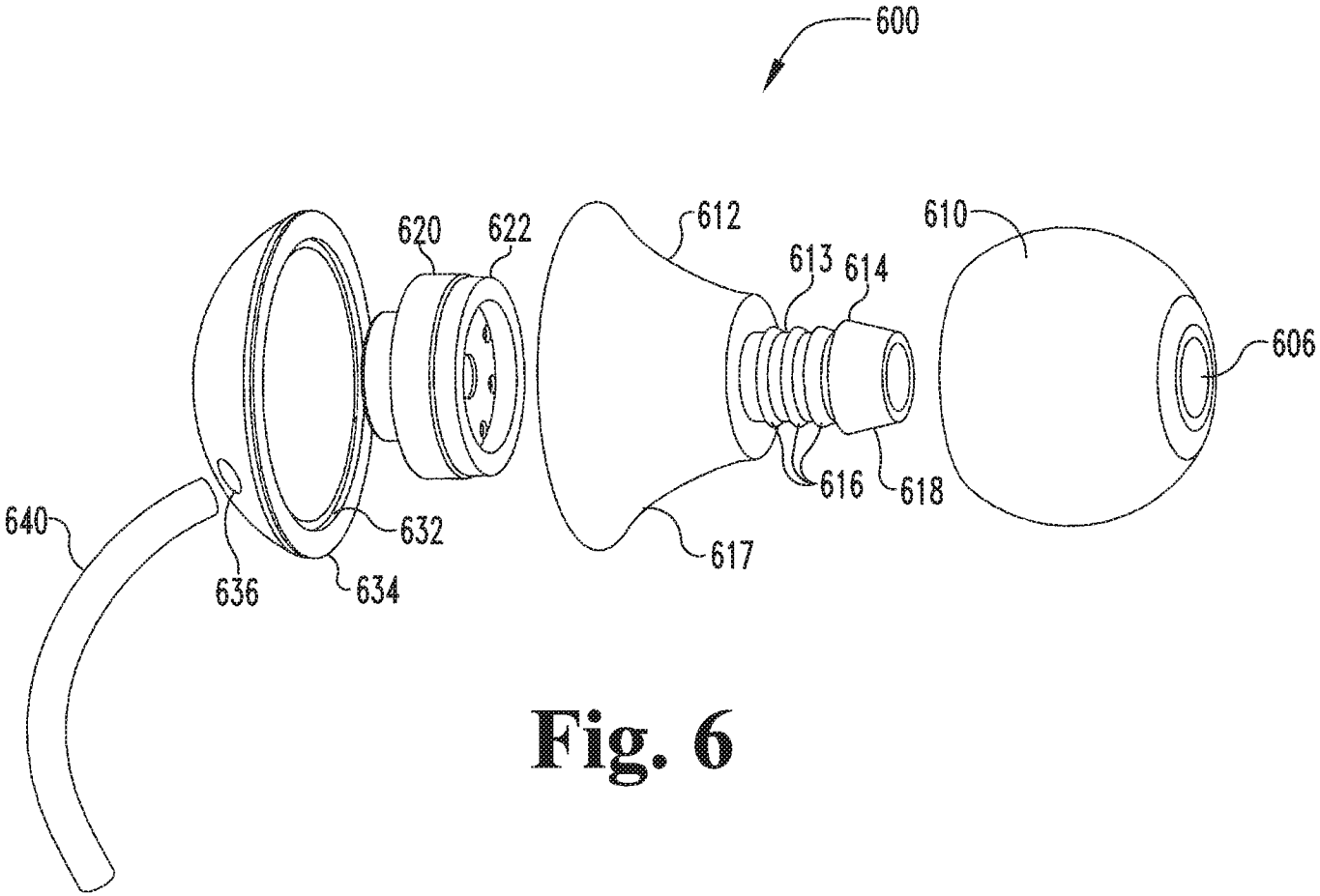
FIG. 6 is an exploded view of a headphone according to one embodiment of the disclosed technology.
Figure 7:
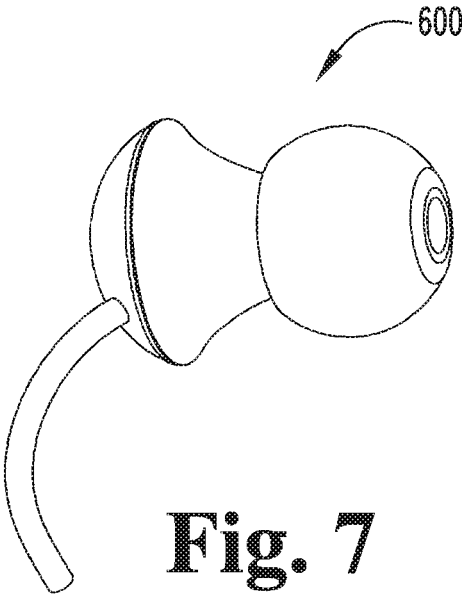
FIG. 7 is an assembled view of the headphone shown in FIG. 6.
Figure 8:
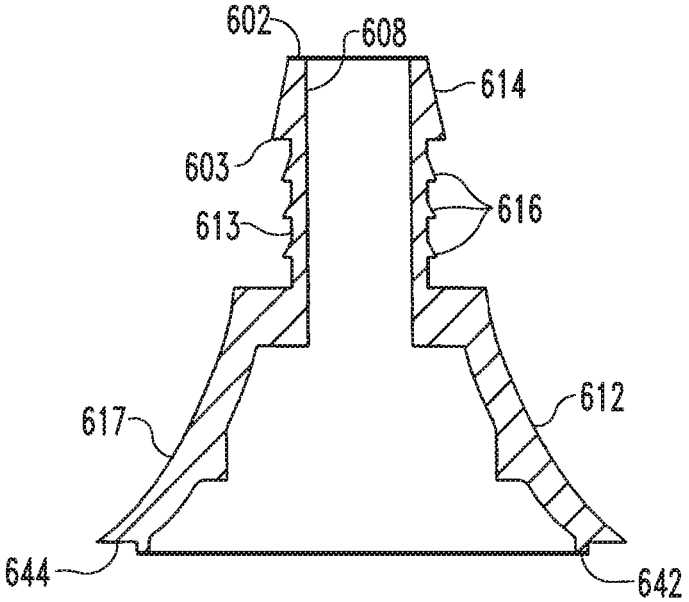
FIG. 8 is a cross sectional view of a headphone post according to one embodiment of the disclosed technology.
Figure 9:
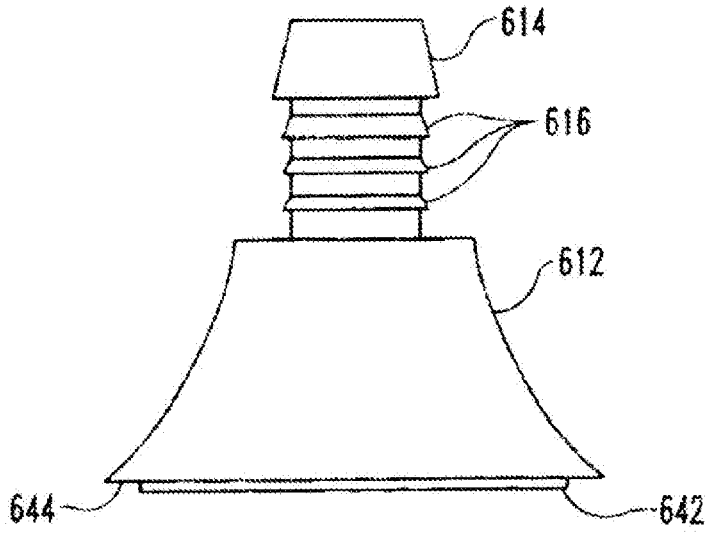
FIG. 9 is a side view of the post shown in FIG. 8.
Figure 10:
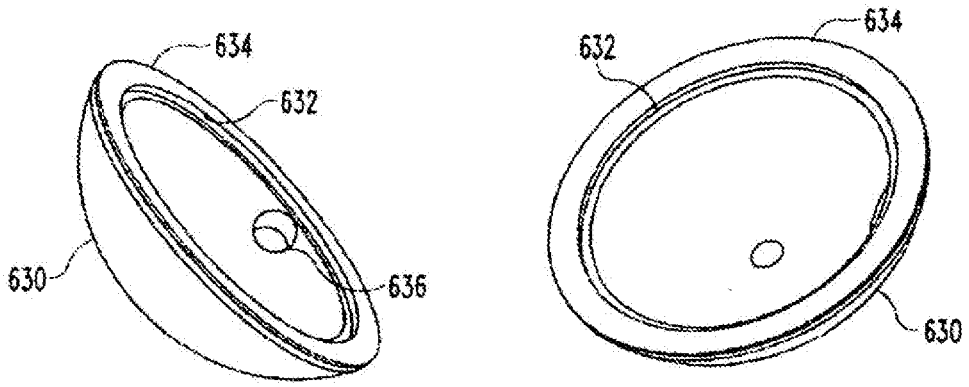
FIG. 10 is a perspective view of headphone backings according to one embodiment of the disclosed technology.
Figure 11:
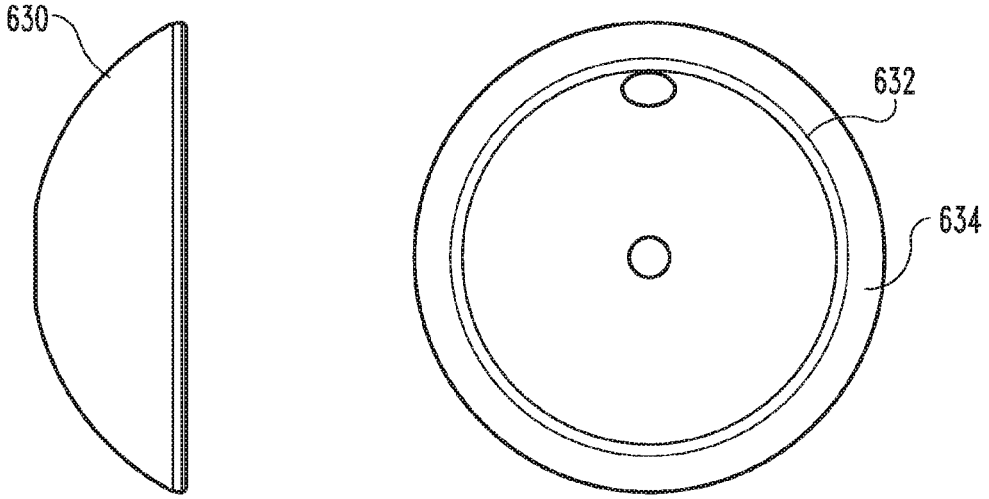
FIG. 11 is a side and top view of the backings shown is FIG. 10.
Figure 12:
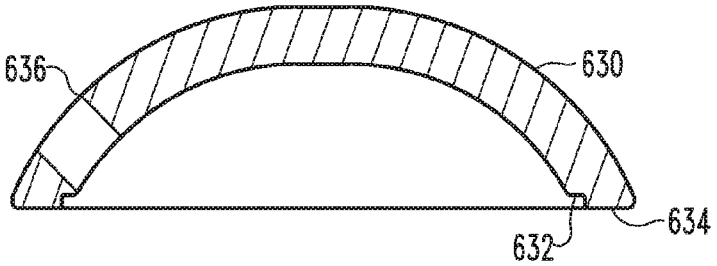
FIG. 12 is a partial cross sectional view of the backing shown in FIG. 10.

FIGS. 6-7 show a collapsed and exploded view of a headphone according to another embodiment of the disclosed technology. FIGS. 8-12 show close up and/or isolated views of the various component parts of the headphone shown in FIGS. 6-7. In this particular example, a waterproof headphone 600 includes a speaker 620, a speaker housing 630, a housing cover 612 having an earbud attachment post 618, and an earbud 610. The earbud 610 shown in this example is a spherical-type bud having a hole 606 therethrough to allow sounds to more easily reach the user's ear, but earbuds of other designs could also be used. The speaker 620 typically includes a foam ring 622 which helps hold the speaker in place while allowing it to vibrate. The speaker housing 630 includes a port 636 through which a speaker wire 640 passes. The interface between the port 636 and the wire 640 is waterproofed by a suitable means. One method of waterproofing the joint between the wire and the housing involves a glue joint where a waterproof adhesive can seal between the wire and the housing. The gap is designed to provide sufficient area to seal out water and provide adhesion to both the wire and the housing. The wire is initially pushed further into the housing when the adhesive is not yet cured and then pulled back to thoroughly distributing the glue in the joint. Any excess glue on the outside may be wiped away. Optionally, a knot in the wire or other feature in the housing may act as a strain relief to stop the wire from pulling out too far. The speaker housing 630 further includes at least one groove 632 and generally flat interface 634 which circumscribe the housing and are configured for forming a water tight interface between the housing 630 and the housing cover 612 which will be described in greater detail below.

Housing cover 612 comprises a mounting post 618 upon which a variety of earbuds may be removably mounted. The housing cover 612 is generally hollow and defines an opening 608 passing therethrough which allows sound to travel from the speaker 620 through the housing cover 612 and to the user's ear. The mounting post 618 includes a top portion 614 and a cover portion 617 connected by a shaft 613. The top portion in this example comprises a leading edge 602 distal from the housing 630 and a trailing edge 603 proximal to the housing 630. The leading edge is generally narrower/smaller in diameter than the trailing edge 603 so as to generate an interference fit between the earbud 610 and the housing cover 612. The shaft 613 includes one or more barb-like protrusions 616 which circumscribe the shaft 613. Generally these protrusions 616 have a smaller diameter than the trailing edge 603 of the top portion 614 of the mounting post. In some examples the protrusions have a diameter less than the diameter of the leading edge of the top portion of the mounting post. In other examples the protrusions have a diameter greater than the diameter of the leading edge of the top portion of the mounting post but less than the diameter of the trailing edge. The protrusions generally have a greater diameter at their end proximal to the housing 630 than the diameter at their distal end from the housing. The protrusions may have identical diameters to each other or they may have different diameters from each other. The protrusions interface with the walls of the opening 606 in the earbud 610 to form an interference fit and help secure the ear bud to the post 613. Additionally, the protrusions 616 and the top portion 614 act to prevent water from leaking between the earbud 610 and the shaft 613 and entering the housing 630 through the hollow opening 608 or entering the wearer's ear through the earbud opening 606.

Housing cover 612 further includes an interface portion for engaging the speaker housing 630 in a generally water tight fashion. In this example, the interface between the speaker housing 630 and the housing cover 612 comprises a ridge or tongue 642 which corresponds to and compliments a groove 632 on the housing 630 as well as a generally flat surface 644 which corresponds with a generally flat surface 634 on the housing 630. The interface between the housing 630 and the housing cover 612 may be sealed water tight using adhesives, glue, epoxy, ultrasonic welding, a combination of two or more methods or by other suitable means.

Figure 13:
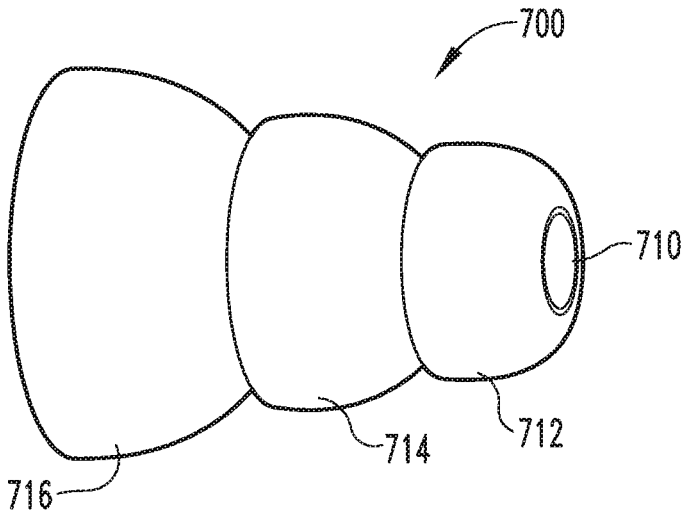
FIG. 13 is a perspective view of one headphone earbud design usable with the disclosed technology.
Figure 14:
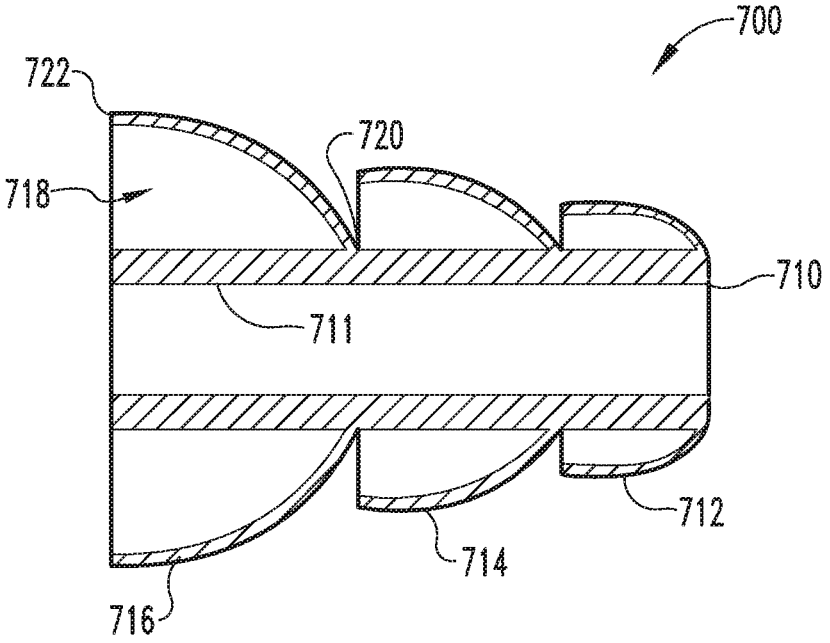
FIG. 14 is a cross sectional view of the headphone earbud design shown in FIG. 13.
Figure 15:
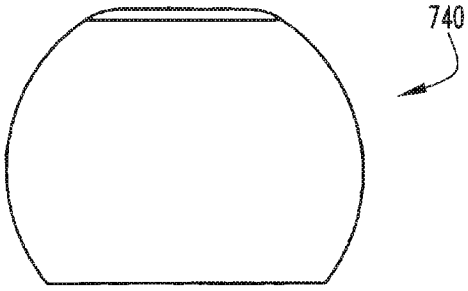
FIG. 15 is side view of another headphone earbud design usable with the disclosed technology.
Figure 16:
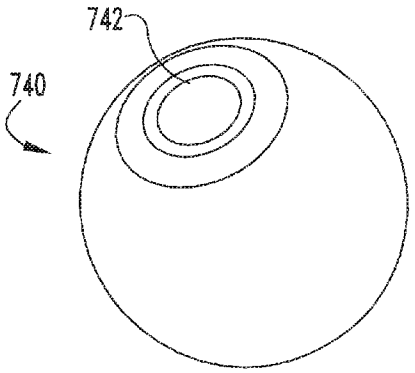
FIG. 16 is a perspective view of the headphone earbud design shown in FIG. 15.
Figure 17:
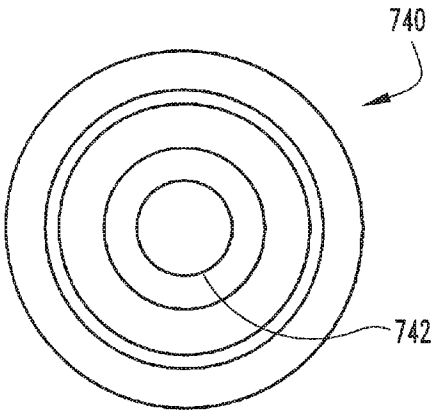
FIG. 17 is a bottom plan view of the headphone earbud design shown in FIG. 15.
Figure 18:
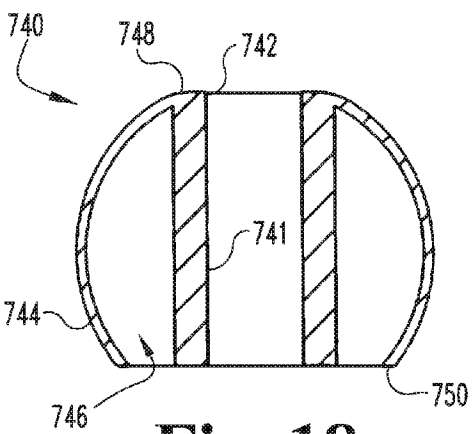
FIG. 18 is a cross sectional view of the headphone earbud design shown in FIG. 15.
Figure 19:
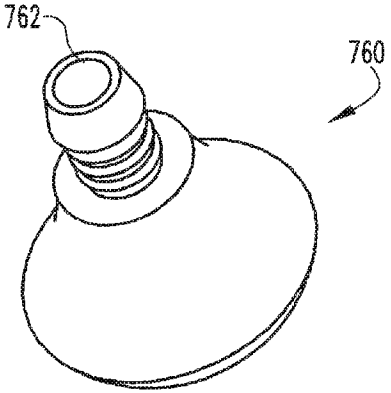
FIG. 19 is a perspective view of a headphone according to one embodiment of the disclosed technology.
Figure 20:
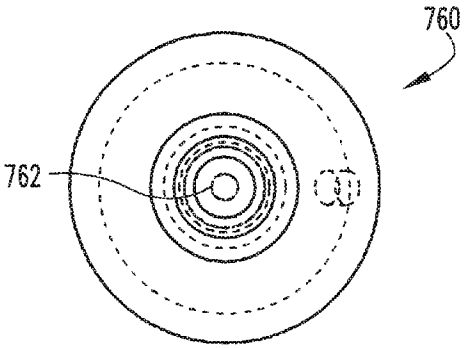
FIG. 20 is a top plan view of the headphone shown in FIG. 19.
Figure 21:
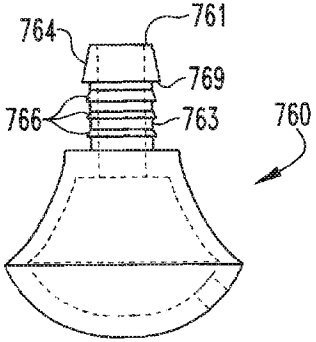
FIG. 21 is a side view of the headphone shown in FIG. 19.
Figure 22:
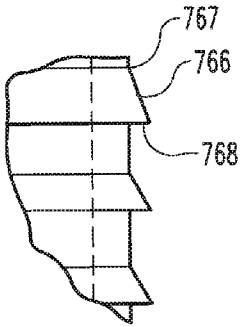
FIG. 22 is a close up view of a portion of the headphone shown in FIG. 19.

FIGS. 13-14 show an example of a different type of ear bud which may be used with the headphone designs disclosed herein. In this example, the earbud 700 comprises a plurality of hemispherical-shaped flaps 712, 714, 716 of generally increasing diameter. In this example, three flaps are shown, but more or fewer flaps may also be used. A hollow tunnel or tube 710 passes through the center of the earbud 700 allowing sound to travel from a speaker to the user's ear and allowing the earbud to be mounted to a speaker housing. Each flap 712, 714, 716 has a proximal end 720 which is attached to the central wall 711 of the earbud which defines the tube 710 and a distal end 722 which is unattached to the earbud. This configuration defines a generally open space 718 between each flap and the wall 711 which allows the flaps to compress upon insertion into the wearer's ear to seal out water.

Another example of an earbud 740 is shown in FIGS. 15-18. In this example, the earbud includes an opening 742 defined by a wall 741 to allow sound to travel from a speaker to the user's ear. A single hemispherical flap 744 is attached to the wall 741 at a proximal end 748 and is open at a distal end 750 thereby defining a generally open space 746 between the flap 744 and the wall 741. This configuration allows the flap to be compressed when the bud is inserted in the user's ear to seal out water.

A waterproof speaker housing design similar to that shown in FIGS. 6-12 is shown in FIGS. 19-22. In this example, a housing 760 includes an opening 762 connecting the exterior of the housing to the generally hollow interior of the housing where a speaker is housed. The housing 760 includes a shaft portion 763 for attaching an earbud where the shaft portion 763 includes an end 764 and a plurality of protrusions 766. The end 764 of the shaft portion includes a distal end 761 from the housing body and a proximal end 769 from the housing body which circumscribe the shaft 763. The distal end 761 of the end is generally smaller in diameter than the proximal end 769 giving the end 764 a flared appearance. Each of the plurality of protrusions 766 include a distal end 767 distal from the housing body and a proximal end 768 proximal to the housing body. The distal end 767 of each protrusion is generally smaller in diameter than the proximal end 768. Typically, the proximal end 768 of each protrusion 766 is smaller in diameter than the proximal end 769 of the end 764 of the shaft 763.

Figure 23:
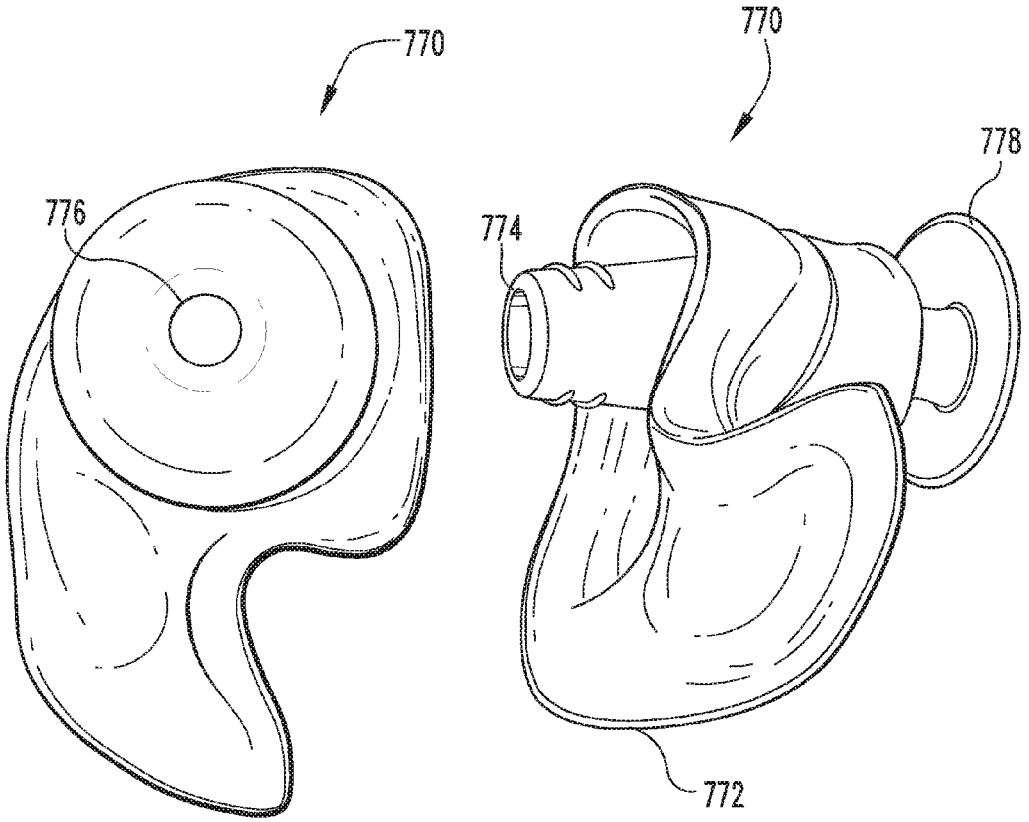
FIG. 23 is a view of another headphone earbud design usable with the disclosed technology.
Figure 24:
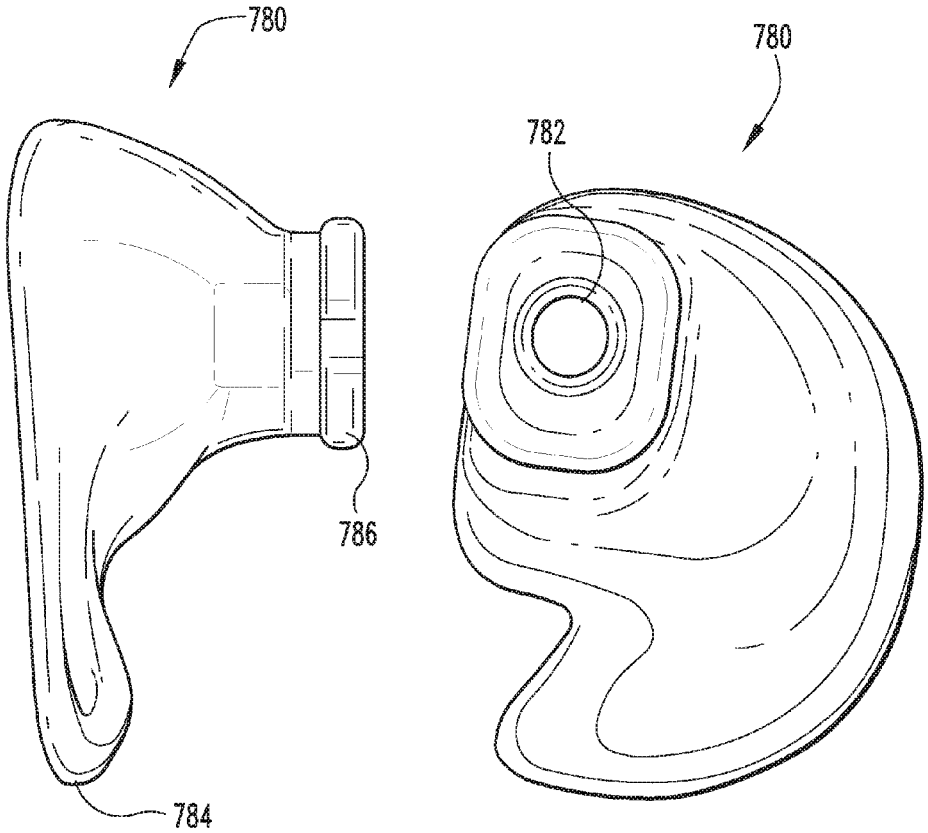
FIG. 24 is a view of still another headphone earbud design usable with the disclosed technology.

FIGS. 23-24 show alternate examples of ear bud designs which may be used with the headphones disclosed herein. FIG. 23 shows an end and side view of an earbud 770 having a body portion 772 designed to fit within the ear of a user. The bud 770 further includes a plug portion 774 configured for insertion into the user's ear and having an opening 776 passing therethrough and a mounting portion 778 configured for mounting to a headphone such as those disclosed herein. FIG. 24 shows an end and side view of an earbud 780 having a body portion 784 designed to fit within the ear of a user. The bud 780 further includes a mounting portion 786 configured for mounting to a headphone such as those disclosed herein and having an opening 782 passing therethrough.

Figure 25:
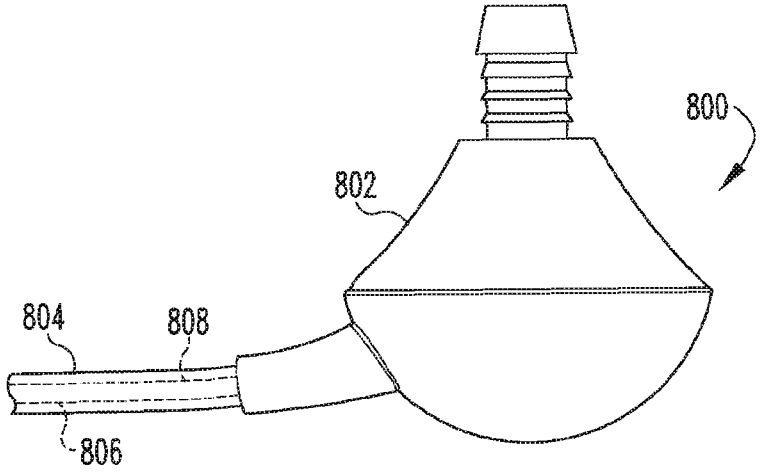
FIG. 25 is a partial cross sectional view of a headphone and cable according to one embodiment of the disclosed technology.

FIG. 25 shows a waterproof headphone 800 according to another example of the disclosed technology. In this example the headphone 800 includes a generally waterproof speaker housing 802 operationally attached to a speaker wire 804. The wire 804 may be of whatever length as desired for a particular application. Optionally, the wire may be integrated into or mounted on a rigid or semi-rigid frame or bracket. The speaker wire 804 in this example comprises a metal wire portion 808 covered by an insulation portion 806. The insulation portion may be as thick or as thin as desired, but is generally sufficiently thick so that there is sufficient material so as to increase the buoyancy of the headphone and wire in water. In one example the insulating material is of sufficient thickness so that the headphone and wire have a neutral buoyancy. In another example the insulating material is of sufficient thickness so that the headphone and wire float in water. The insulating portion may be made of plastic, rubber, waterproofed foam, or other suitable materials or combinations thereof.

Figure 26:
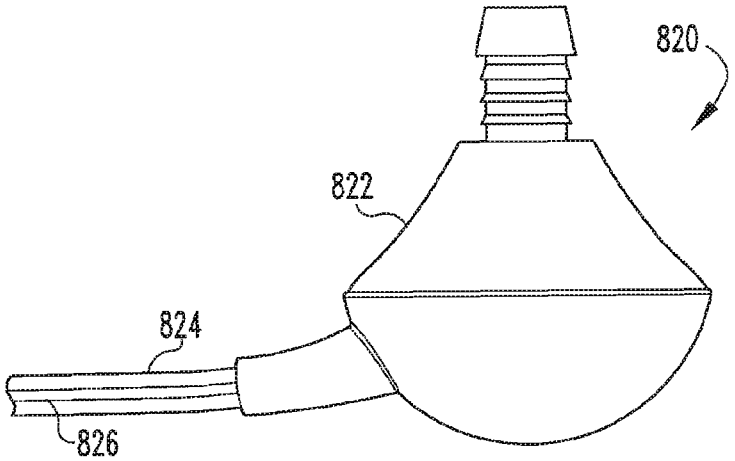
FIG. 26 is a partial cross sectional view of a headphone and cable according to another embodiment of the disclosed technology.
Figure 27:
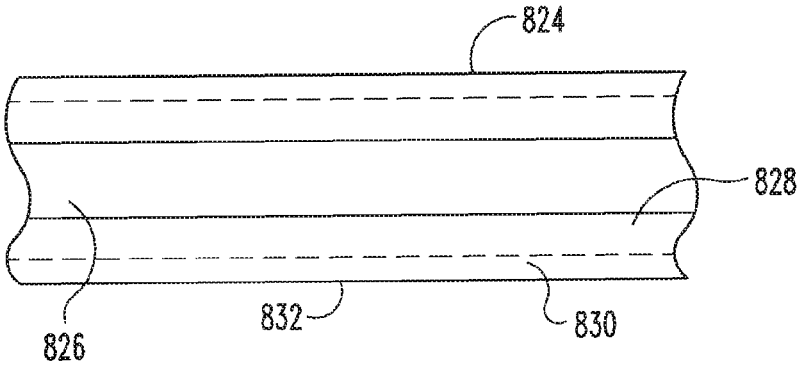
FIG. 27 is a close up partial cross section of the cable shown in FIG. 26.

FIGS. 26-27 show a waterproof headphone 820 according to another example of the disclosed technology. In this example the headphone 820 includes a generally waterproof speaker housing 822 operationally attached to a speaker wire 824. The wire 824 may be of whatever length as desired for a particular application. Optionally, the wire may be integrated into or mounted on a rigid or semi-rigid frame or bracket. The speaker wire 824 in this example comprises a metal wire portion 826 covered by a first insulation portion 828. The first insulation portion 828 is enclosed by a second insulation portion 832 which is separated from the first insulation portion 828 by an air cavity 830 which gives the speaker wire 824 buoyancy. Optionally, the air cavity may be larger or smaller as desired or may be comprised of two or more separate air cavities so as to prevent a leak in one portion of the wire from compromising the buoyancy of the entire wire. In one example the air cavity is of sufficient thickness so that the headphone and wire have a neutral buoyancy. In another example the air cavity is of sufficient thickness so that the headphone and wire float in water. The insulating portions may be made of plastic, rubber, waterproofed foam, or other suitable materials or combinations thereof.

Figure 28:
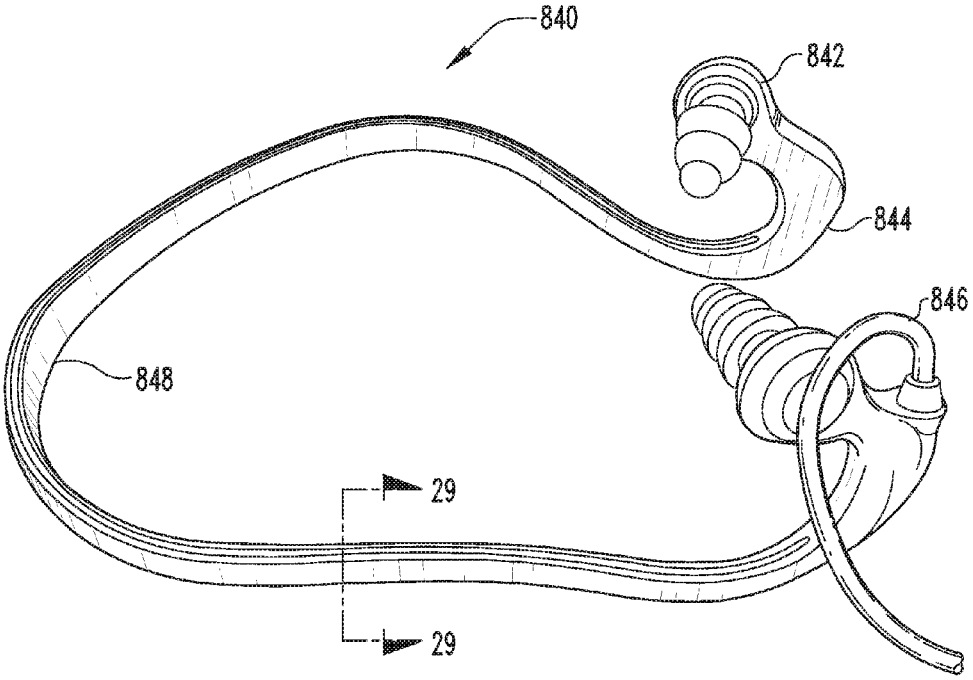
FIG. 28 is a perspective view of waterproof headphones according to another embodiment of the disclosed technology.
Figure 29:
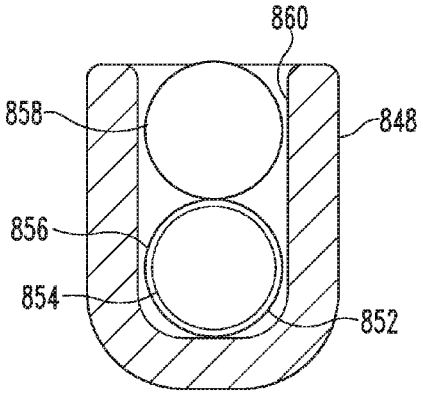
FIG. 29 is a cross sectional view of the headphones shown in FIG. 28 taken along line 850-850.

FIGS. 28-29 show an example of waterproof headphones according to one embodiment of the disclosed technology using a rigid frame or member. In this example, the headphones 840 include a pair of speaker housings 842 which may be similar to those previously described. Each speaker housing 842 may be integrated into a secondary housing 844 which is generally hollow and sealed so as to be water tight. Air trapped in the secondary housing 844 contributes to the buoyancy of the headphone unit. Optionally, secondary housing 844 comprises two or more individual chambers so a leak in one chamber does not completely compromise the buoyancy provided by the housing. The speaker in each speaker housing 842 is operationally connected by a speaker wire 852 which travels in a channel 860 in the bracket 848. The headphones are then connected to a signal source such as a radio, mobile phone, mobile music playing device, and the like by a wire 846 which is equipped with a suitable interface jack (not shown).

The speaker wire 852 typically includes a conductive core 854 covered by an insulating layer 856 as is known in the industry. Optionally, the wire may be of the type discussed above with respect to FIGS. 25-27. Additionally, the channel may also include a buoyancy device 858 comprising one or more lengths of hollow tubing. Air within the tubing contributes to the buoyancy of the headphones. In other examples, the tubing is sized so that it forms and interference fit with the sides of the channel so as to help hold the speaker wire 852 in place as well as contribute to the buoyancy of the headphones. The buoyancy device 858 as well as the secondary housings 844 may be used individually or in combination in a particular set of headphones. The buoyancy device 858 as well as the secondary housings 844 may be sized and configured so as to give the headphones an overall neutral buoyancy (so they neither sink nor float in water) or a positive buoyancy so the headphones float.

Figure 30:
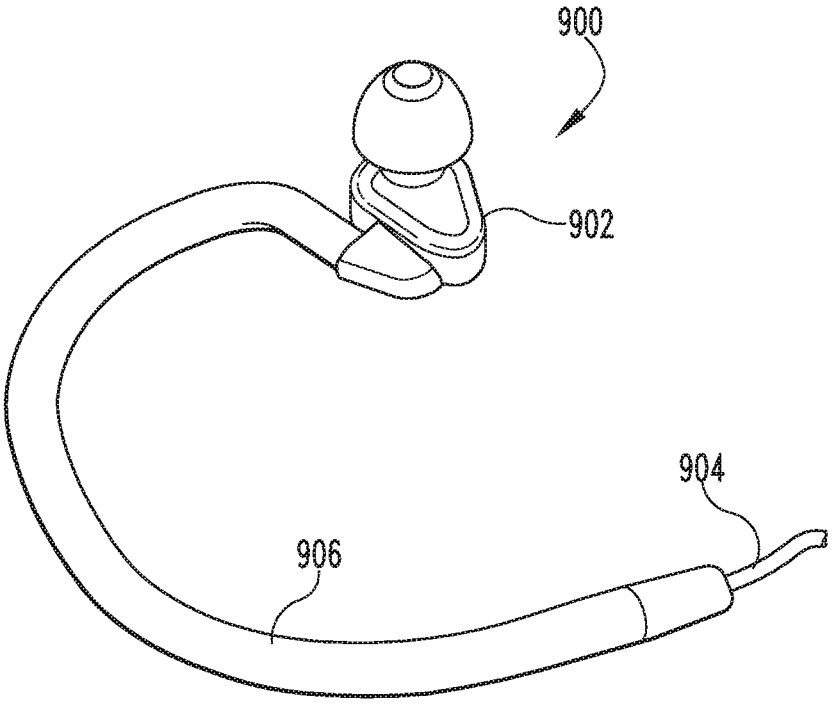
FIG. 30 is a perspective view of waterproof headphones according to still another embodiment of the disclosed technology.

Another example of a waterproof headphone according to the disclosed technology is shown in FIG. 30. In this particular example, the headphone 900 comprises two individual speaker housings 902 (one shown) which may be similar to those previously described. The housings 902 are operationally joined by a speaker wire 904 which may be of the type which improves buoyancy as previously described. A portion of each speaker wire 904 is covered by a flexible material 906 which may have shape-memory properties. The material may be a polymer, metal, rubber, or similar suitable material so long as it has the ability to hold a shape when bent by the user. The flexible material 906 may be shaped by the user into a comfortable and convenient form so as to wrap over and around the back of the user's ear when the earbud is in use. Optionally, the flexible material 906 may also entrap one or more air chambers so as to increase the buoyancy of the headphones.

In the previous examples headphones were shown having speaker wires operationally attaching the paired headphone pieces to one another and/or operationally attaching the headphones to a signal source such as a music playing device, radio, mobile phone, and the like. In other examples, the individual headphones may be operationally attached to one another and/or to a signal source using wireless connectivity means that are known in the art. Such means include, but are not limited to, radio waves, UHF radio such as Bluetooth® (trademark of Bluetooth Special Interest Group, Kirkland, Wash.), Wi-fi, and the like.

While the claimed technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the claimed technology are desired to be protected.

What is claimed is:

1. A waterproof headphone, comprising:

a front housing portion having a sound expansion chamber, a sound funnel, and an earbud mounting post, the earbud mounting post comprising a shaft connected to the sound funnel and a top portion connected to the shaft distal from the sound funnel, the top portion having a diameter greater than the shaft, the shaft including at least one protrusion disposed between the sound funnel and the top portion having a diameter less than the diameter of the top portion;

a rear housing portion joined to the front housing portion and forming a chamber with the front housing portion; and a speaker disposed within the chamber formed by the front housing portion and the rear housing portion;

wherein the diameter of the sound expansion chamber is equal to or less than the diameter of the speaker;

wherein the joint between the front housing portion and the rear housing portion is water tight.

2. The waterproof headphone of claim 1, further comprising an earbud operationally engaged with the earbud mounting post.

3. The waterproof headphone of claim 1, wherein the headphone is positively buoyant.

4. The waterproof headphone of claim 3, wherein air in chamber formed by the front speaker housing and the rear speaker housing causes the positive buoyancy of the headphone.

5. The waterproof headphone of claim 1, wherein the top portion of the earbud mounting post further comprises an end distal from the shaft and an end proximal to the shaft, wherein the proximal end has a diameter greater than the distal end.

6. The waterproof headphone of claim 1, wherein the at least one protrusion of the earbud mounting post further comprises an end distal from the top portion of the shaft and an end proximal to the top portion of the shaft, wherein the proximal end has a diameter greater than the distal end.

7. A waterproof headphone, comprising:

a first earphone of a stereo earbud set, wherein the first earphone comprises a front housing portion having a sound expansion chamber, a sound funnel, and an earbud mounting post, the earbud mounting post comprising a shaft connected to the sound funnel and a top portion connected to the shaft distal from the sound funnel, the top portion having a diameter greater than the shaft, the shaft including at least one protrusion disposed between the sound funnel and the top portion having a diameter less than the diameter of the top portion;

a rear housing portion joined by a water tight joint to the front housing portion and forming a chamber with the front housing portion;

a speaker disposed within the chamber formed by the front housing portion and the rear housing portion;

wherein the diameter of the sound expansion chamber is equal to or less than the diameter of the speaker;

a second earphone of a stereo earbud set, wherein the second earphone comprises a front housing portion having a sound expansion chamber, a sound funnel, and an earbud mounting post, the earbud mounting post comprising a shaft connected to the sound funnel and a top portion connected to the shaft distal from the sound funnel, the top portion having a diameter greater than the shaft, the shaft including at least one protrusion disposed between the sound funnel and the top portion having a diameter less than the diameter of the top portion;

a rear housing portion joined by a water tight joint to the front housing portion and forming a chamber with the front housing portion;

a speaker disposed within the chamber formed by the front housing portion and the rear housing portion;

wherein the diameter of the sound expansion chamber is equal to or less than the diameter of the speaker; and a speaker wire operationally connecting the first earphone to the second earphone.

8. The waterproof headphone of claim 7, further comprising an earbud operationally engaged with each earbud mounting post.

9. The waterproof headphone of claim 7, wherein the headphone is positively buoyant.

10. The waterproof headphone of claim 9, wherein air in each chamber formed by the front speaker housing and the rear speaker housing causes the positive buoyancy of the headphone.

11. The waterproof headphone of claim 7, wherein the top portion of each earbud mounting post further comprises an end distal from the shaft and an end proximal to the shaft, wherein the proximal end has a diameter greater than the distal end.

12. The waterproof headphone of claim 7, wherein the at least one protrusion of each earbud mounting post further comprises an end distal from the top portion of the shaft and an end proximal to the top portion of the shaft, wherein the proximal end has a diameter greater than the distal end.

13. The waterproof headphone of claim 7, wherein the first headphone and the second headphone are connected by a rigid frame.

14. The waterproof headphone of claim 13, wherein the rigid frame includes a channel and wherein the speaker wire is disposed within the channel.

* * * * *